US007743580B2

(12) United States Patent
DeLoach, Sr.

(10) Patent No.: US 7,743,580 B2
(45) Date of Patent: Jun. 29, 2010

(54) TILT-UP ANCHOR AND ANCHOR POCKET FORM

(76) Inventor: W. Michael DeLoach, Sr., 475 Tucker Rd., Winder, GA (US) 30680

( * ) Notice: Subject to any disclaimer, the term of this patent is extended or adjusted under 35 U.S.C. 154(b) by 589 days.

(21) Appl. No.: 11/542,480

(22) Filed: Oct. 3, 2006

(65) Prior Publication Data

US 2007/0028552 A1 Feb. 8, 2007

Related U.S. Application Data

(63) Continuation-in-part of application No. 10/731,635, filed on Dec. 9, 2003, now Pat. No. 7,114,695, which is a continuation of application No. 10/107,561, filed on Mar. 27, 2002, now Pat. No. 6,658,810.

(51) Int. Cl.
*E04C 5/12* (2006.01)

(52) U.S. Cl. ..... 52/708; 52/701; 52/659

(58) Field of Classification Search ..... 52/125.4, 52/125.5, 414, 576, 745.11, 323, 701, 707, 52/708; 249/63, 83, 96, 142, 175, 177
See application file for complete search history.

(56) References Cited

U.S. PATENT DOCUMENTS 4,179,151 A * 12/1979 Tye ..... 294/89
4,930,269 A * 6/1990 Kelly et al. ..... 52/125.5
5,609,005 A * 3/1997 Schierloh et al. ..... 52/699
7,004,443 B2 * 2/2006 Bennett ..... 249/185
2004/0104498 A1 * 6/2004 Schneider ..... 264/31

* cited by examiner

*Primary Examiner*—Brian E Glessner
*Assistant Examiner*—Patrick Maestri
(74) *Attorney, Agent, or Firm*—Womble Carlyle Sandridge & Rice

(57) ABSTRACT

An improved, lightweight, portable, and self-contained concrete form for fabricating tilt-up concrete walls is provided. The form includes a frame made from metal frame members jointed at their ends with the frame members forming the sides of the frame. Optional structural anchors may be attached inside the frame members. The frame members may be channel shaped with their channels facing inwardly. The reinforcing mat comprising a array of crisscrossed rebars is disposed within the frame and is held in place with a plurality of brackets on the ends of at least some of the rebars and welded to respective frame members. The rebar mat is sized to be positioned in the mid portion of the frame and the brackets on the ends of the rebars are slid outwardly into and attached to the frame members by spot welding. The brackets are then spot welded to the ends of their rebars to form a rigid, lightweight concrete frame. The frame may be shipped to a job site, laid on a casting surface, a pocket form placed inside the optional anchor, and filled with concrete. When the concrete cures, the resulting concrete wall, form and all, is tilted-up into place with a crane and may be attached with the anchor to form a section of a concrete wall.

7 Claims, 8 Drawing Sheets

TILT-UP ANCHOR AND ANCHOR POCKET FORM

REFERENCE TO RELATED APPLICATION

This application is a "CONTINUATION-IN-PART" (CIP) of application Ser. No. 10/731,635, filed on Dec. 9, 2003, now U.S. Pat. No. 7,114,695, which, in turn, is a continuation of application Ser. No. 10/107,561 filed on Mar. 27, 2002 now U.S. Pat. No. 6,658,810.

TECHNICAL FILED

This invention relates generally to building construction and more particularly to the fabrication and anchoring of concrete wall panels that are tilted up into place and attached to form the walls of a building.

BACKGROUND

Tilt-up concrete wall panel construction has been used for years to construct commercial buildings such as warehouses, factories, and the like. In general, such construction entails building a rectangular concrete form, usually on site, placing steel reinforcing bars (rebar) or other reinforcement in the form, filling the form with concrete, and, after the concrete cures, tilting the resulting concrete panel into place to form a wall section. Numerous wall sections generally are fabricated and attached together and to framing members of the building to form complete walls. Utility conduits may be embedded within the wall sections as needed to provide for electricity and plumbing. U.S. Pat. Nos. 3,394,523 of Sackett, 4,104,356 of Deutsch et al., 3,604,174 of Nelson, and 4,856,244 of Clapp disclose various examples of tilt-up concrete wall panel construction techniques.

While traditional concrete wall panel construction techniques have been somewhat successful in construction commercial buildings, they nevertheless have been fraught with a variety of inherent problems and shortcomings. Among these are the fact that, in most cases, the forms into which the concrete is poured usually are fabricated from wood or metal on site at a worksite such as, for example, on the ground adjacent to where they are to be tilted up to form a wall. The on-site building of such forms is a tedious and time consuming process and further requires a high level of skill on behalf of workers to assure that the panels are all the correct size and configuration. In additional, where wooden forms are used, the process of disassembling the framing members and discarding them after the concrete cures can be time consuming and wasteful. In most cases, reinforcing stakes, spacers, or blocks must be used to reinforce the sides of the concrete forms so that they do not bow outwardly or otherwise deform under the substantial pressures created by the wet concrete poured into the forms. Installing theses reinforcing members is yet another time consuming step in the process.

Another problem with prior art techniques relates to the installation within the concrete forms of the rebar, wire mesh, or other reinforcing members that are to be embedded within the finished wall sections. More particularly, the construction of a matrix of reinforcing members is a time consuming and tedious process. This is particularly true in systems where the walls of the form are made from inwardly open channel shaped steel or formed sheet metal. The reason is that the reinforcing members must be installed in the mid-portion of the form between the inwardly projecting lips of the walls. In order the accomplish this, the framing members must be cut to be longer than the distance between the facing edges of opposed lips and jockeyed into place in the middle of the form before being secured in place within the form.

Typical of the current art form, concrete wall panels are anchored by the use of threaded dowel rods and/or steel weld plates which are positioned in the wall panel prior to placing concrete and then after concrete placement a portion of the anchor is left exposed from the concrete to allow for the alignment with an adjoining anchor to connect the panel in place. Anchor dowels and/or plates are applied to the panel at the job site, frequently at the time of concrete placement. This results in the negative occurrences of inaccurate anchor placement, the need for extremely accurate anchor positioning for alignment, omission of anchors, anchors covered by or lost within concrete, and the need for special welding equipment with specially skilled field welding techniques.

There exists a need for an improved tilt-up concrete wall form and a method of fabricating concrete wall sections using the form that addresses and solves the above mentioned and other problems of the prior art. The form should be lightweight, strong, and portable so that they can be manufactured to exacting tolerances at a remote location and delivered to a job site on a truck for immediate use. The form assembly should also increase efficiency and accuracy of wall panel installation while minimizing construction mistakes and waste. Further, the form should be usable without the need for any on-site form construction and without the need to reinforce the walls of the form against bowing under pressure when concrete is poured into the form. No deconstruction of the form should be required after the concrete cures and no wasted that requires disposal should be generated during use of the form. At a remote form fabrication facility, fabrication should be quick and efficient and the installation of a matrix of reinforcing rebar in the mid-portion of the form should be accurate, quick, and efficient while also providing exacting and labor-saving structural anchor points. An improved method of fabricating the tilt-up concrete wall sections using such an enhanced form also should be included. It is to the provision of such a form and method of construction that the present invention is primarily directed.

SUMMARY OF THE INVENTION

Briefly described, the present invention in a preferred embodiment thereof, comprises an improved form for fabricating tilt-up concrete wall sections and an improved method of fabricating tilt-up concrete wall sections using the form. The form generally includes C-shaped or channel-shaped roll formed sheet metal frame members that are welded together at their ends to define the shape of the form, which may be rectangular for many applications but that also may take on other shapes according to applications specific requirements. A matrix or mat of crisscrossed rebar is disposed in the form to provide reinforcement when concrete is poured into the form during fabrication of a concrete wall section. Each rebar of the matrix extends between opposed frame members of the form and is cut to be short enough to slip into the mid-portion of the form past the inwardly extending flanges of the C-shaped frame members. A unique bracket is slidably disposed on the ends of at least some of the rebars of the rebar mat and each bracket is spot welded to the corresponding frame member and to its rebar. This configuration establishes structural integrity of the assembly. Brackets may be disposed on the ends of each rebar or just on the ends of selected ones of the rebars as necessary to hold the reinforcing mat in place and to establish the desired structural integrity. The form is fabricated at a remote manufacturing facility as follows. First, the roll formed sheet metal frame members are cut to size and welded together at their ends to define a frame of the appropriate size an shape. The generally channel-shaped frame members are oriented with their open or channeled sides facing inwardly toward the middle or the form. In other words, the flanges on the edges of the frame members face inwardly toward each other and thus may be referred to as inwardly extending flanges. Down turned lips preferably are formed along the edges of the flanges to add strength and rigidity.

During the fabrication process, prior to the generally channel-shaped frame members being attached together or to rebars being inserted, a unique anchor is welded to the frame at a pre-designated interval and location within the channel-shaped frame between the inwardly extending flanges. The unique anchor preferably is a metal assembly with legs supporting a square metal plate which has an opening near the center, the opening or hole may be of various dimensions and shapes but generally is square or round. The hole is lined with a steel tube and the legs, and the steel tube and metal plate are all welded into an assembly to make the unique anchor. A hole in the generally channel-shaped frame is made during fabrication to correspond with and align to the opening in the unique anchor. The unique anchor will have additional rebars attached, prior to placement within the channel-shaped frame or during rebar mat placement within the channel-shaped frame assembly. Size and number of additionally attached rebars will be determined by the structural anchoring requirements to meet the associated engineering design of the final wall panel.

The crisscrossed rebar mat is then constructed by arranging individual rebars and welding them together at their intersections. A bracket is slid onto the ends of each rebar until the rebar ends protrude from the base of the bracket. With the mat constructed and brackets installed, the entire rebar mat can be positioned in the form. Since the rebars are cut short as mentioned above, the entire rebar mat slips easily past the inwardly extending flanges of the frame members and into the middle of the form. With the rebar mat properly positioned within the form, the brackets on the ends of the rebars are slid toward the frame members until the base of each bracket rests against the outside panel of the frame member between its inwardly projecting flanges. The base portions of the brackets are configured to extend between the flanges of the frame members, thereby automatically centering the rebar mat in the middle of the form. The bases of the brackets are then spot welded to the frame members and the end of each rebar is spot welded to its respective bracket to complete the form. It will thus be seen that the rebar mat is automatically centered and held in place by the brackets. Further, since the rebar mat is welded together and to the brackets, and the brackets are welded to the frame members, the completed form is strong and rigid and maintained in its proper shape by the installed rebar mat.

Since the forms of the present invention are lightweight and rigid, they may be handled, and shipped to the jobsite where they are to be used to fabricate concrete wall sections, and unloaded at the job site without fear of the forms becoming warped or deformed. Once at the jobsite, the forms are laid flat on a casting surface, such as a concrete slab, preferably near the location where concrete wall sections are to be erected. A unique pocket form or void form is inserted into the opening of the unique anchor prior to adding the wet concrete. The shape of the unique pocket form automatically positions the face toward the wall panels surface and holds it in place. The unique pocket form also has small tabs on its face which will stand erect and protrude above the concrete surface to aid in identifying the unique anchor locations after the concrete is set and cured. The forms are then filled with concrete from a concrete truck, a pump truck, or other source. Again, since the brackets are welded to the frame members and the rebars of the mat welded to the brackets the rebar mat ties the framing members together and prevents them from bowing or bulging outwardly under the pressure of the wet concrete. Accordingly, no further reinforcing blocks or other reinforcement is required prior to pouring the concrete into the forms as is common in prior art systems.

When the concrete is cured, the pocket form is removed and will leave an opening or void in the concrete to allow worker access to the unique anchor for the wall panel final installation.

When the concrete is cured, the resulting concrete wall sections may be tilted up using a derrick or crane and sling arrangement until they are in their proper positions, whereupon they may be attached together and/or to structural support members of the building to form walls. The unique anchor provides a structural platform within the present invention which can be used to anchor the finished concrete wall panel. Further, once the finished concrete wall panel is tilted-up and positioned into it's designated location, the opening or hole in the unique anchor is used by workers as a tool guide to create an anchoring hole to the adjacent structural element. The void in the concrete created by the pocket form allows access to the hole in the unique anchor and is large enough to provide clearance for hole-making tools, such as drills or other tools. After the hole is created, a connecting anchor device, such as a bolt, threaded dowel or other device, may be added as the structural securement which passes through the unique anchor and into the adjacent structural element.

Exact alignment between connection elements of the finished concrete wall panel and the to-be-connected adjacent structural element no longer exists with the described invention because the wall panel connection with the unique anchor does not require the adjacent element to have a pre-placed attachment. This alleviates the need for exacting match-up tolerances at connection points where the unique anchor is used, the connection point is determined after the finished concrete wall panel is in position and the unique anchor provides the exact hole placement after proper wall positioning is achieved. The remote site welded placement fabrication of the unique anchor ensures it will not move during the application of wet concrete at the work-site which helps eliminate misplaced, lost or omitted anchors. Any required welding is completed during fabrication at the remote site before being shipped to the work-site, therefore no special welding equipment or welding skills would be required at the work-site.

All of the elements of the form remain with the finished concrete wall sections and become a part of the finished wall. Accordingly, no disassembly of the form is required after the concrete cures and no waste that must be discarded is produced.

Thus, a unique and improved tilt-up concrete wall section form is now provided that is quickly, accurately, and efficiently fabricated at a remote manufacturing facility. The form is rigid and self reinforcing and may be handled and shipped to a job site, where it is simply laid on a casting surface and filled with wet concrete without the need for on-site construction or ancillary reinforcing members to prevent bowing of the form. When the concrete cures to form a wall section, the entire structure, form and all, is tilted up and attached to form a concrete wall without any disassembly or waste and without connection match-up difficulties or special work-site welding. The method of fabricating tilt-up concrete walls using forms of the present invention is efficient and substantially quicker than with prior art tilt-up wall systems. These and other features, objects, and advantages of the form and fabrication method of the invention will become more apparent upon review of the detailed description set forth below when take in conjunction with the accompanying drawing figures, which are briefly described as follows.

DETAILED DESCRIPTION OF THE PREFERRED EMBODIMENTS

Figure 1:
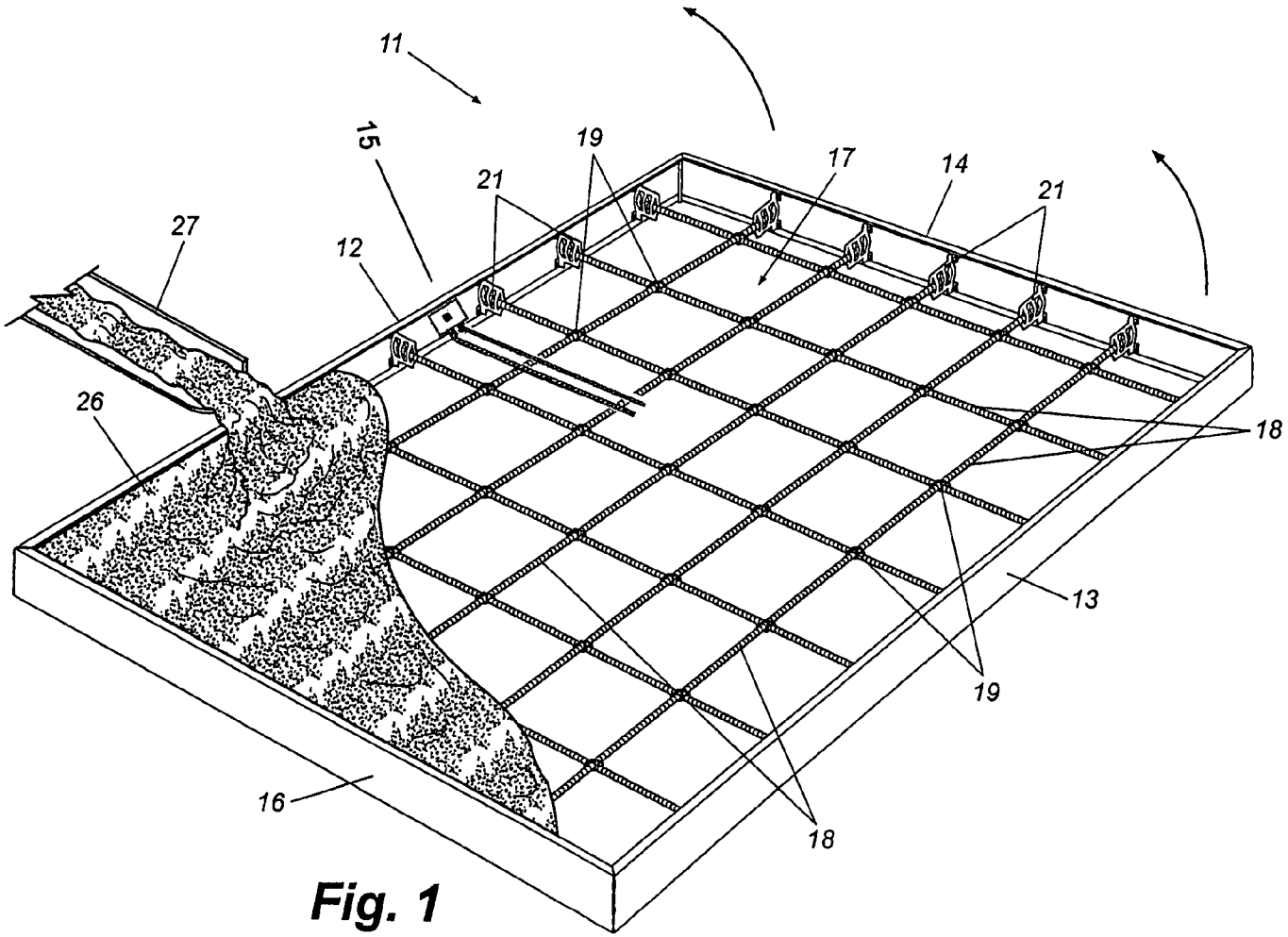
FIG. 1 is a perspective view of a tilt-up concrete wall form that embodies principles of the present invention in a preferred embodiment.
Figure 2:
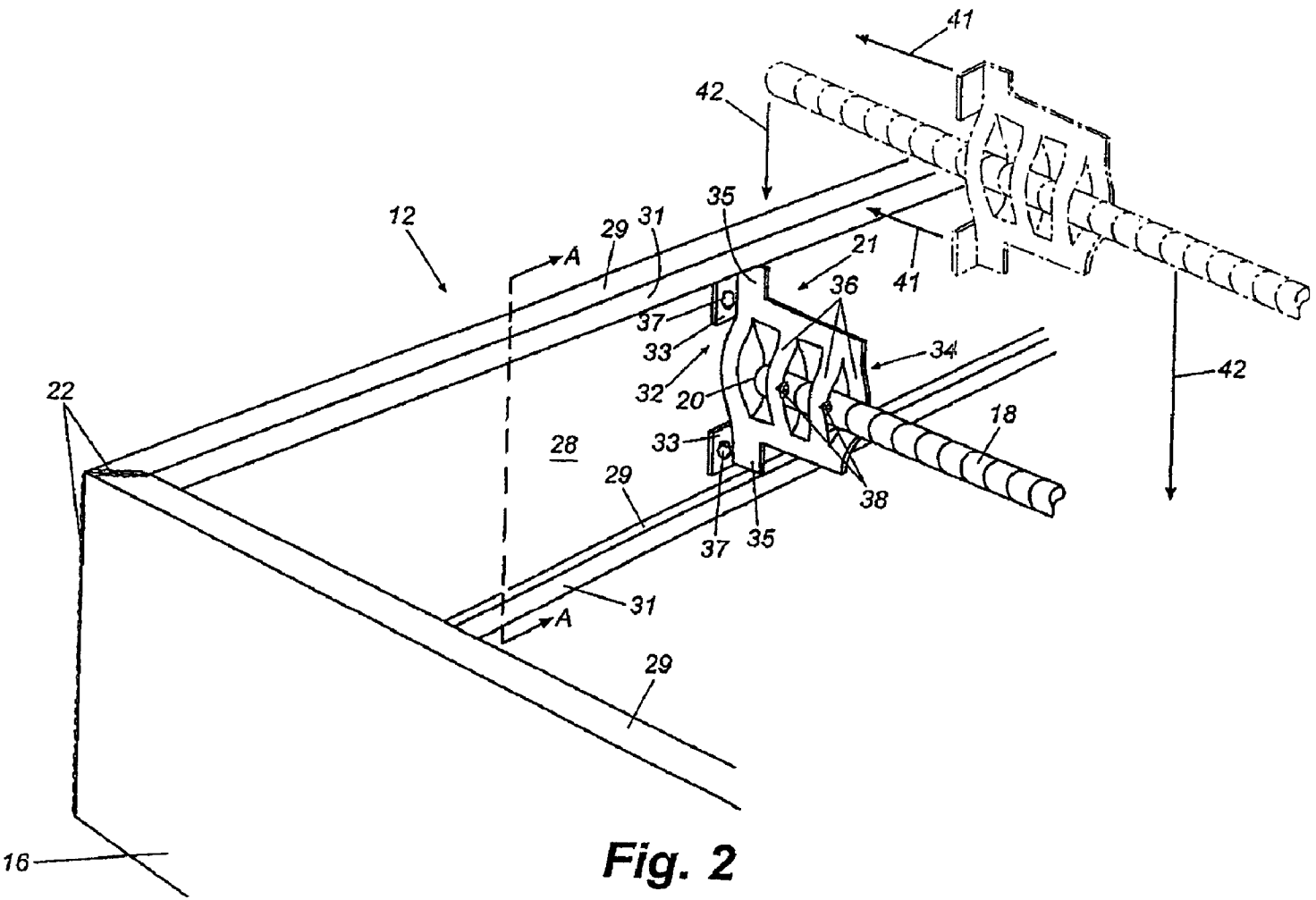
FIG. 2 is a close-up perspective view of a portion of the form of FIG. 1 showing details of the unique brackets for securing the rebar mat in place and illustrating installation of the rebar mat.

Referring now in more detail to the drawings, in which like reference numerals refer to like parts throughout the several views, FIG. 1 illustrates a preferred embodiment of the tilt-up concrete wall section form of the invention. The form 11 includes a pair of spaced apart side frame members 12 and 13 joined at their ends by a pair of end frame members 14 and 16 respectively. The frame members 12, 13, 14 and 16 preferably are formed from roll-formed sheet metal and, as discussed in more detail below, are generally C-shaped or channel shaped having inwardly extending flanges 29 and down turned lips 31 (best shown in FIG. 2). This configuration provides for rigid and strong frame members that nevertheless are lightweight. The frame members that define the frame of the form preferably are welded together at the frame corners by means of weld joints 22 (FIG. 2). Alternatively, some of the corners might be formed by appropriately bending a longer piece of frame stock of desired.

A rebar mat 17 is positioned in the form spanning the frame members and, in the preferred embodiment, is formed from individual rebars 18 crisscrossed with respect to each other and spot welded or otherwise attached together at their intersections 19. This forms a rebar mat that is rigid, strong, and not subject to being racked or deformed under stress. As discussed in more detail below, each rebar is cut short enough so that the rebar mat can be slipped into the mid-portion of the form past the inwardly extending flanges of the frame members. Thus, the rebar mat can be fabricated separately from the frame, whereupon it is simply placed in position within the frame.

Anchors 15 can be place at desired locations and spacing along the length of the frame as maybe required. A sliding bracket 21 is mounted on each end of the individual rebars. The brackets 21 are slid onto the ends of the individual rebars before the rebar mat is positioned within the frame. When the mat is in position within the frame, the brackets are slid outwardly until they engage the outside panels of the frame members. As discussed in more detail below, the brackets are configured so that when they are slid out and engaged the frame members, they automatically center their respective rebars within the form between the inwardly extending flanges of the frame members. Once in place, the base portions 32 (FIG. 2) of the brackets are spot welded to the frame members and the brackets are spot welded to the end portions of their respective rebars. This creates a completed form that is lightweight compared to prior art forms but that nevertheless is rigid and strong so that a plurality of such forms can be shipped from a manufacturing facility to a jobsite on a flat bed trailer with little danger of the forms becoming racked, deformed, or otherwise damaged during shipment.

In use, forms according to the present invention are fabricated in a manufacturing facility as described and shipped to a jobsite where tilt-up concrete walls are to be made and erected. There, the forms are located and laid flat on a casting surface, such as a concrete slab, preferably near where the concrete wall sections ultimately will be erected. The prefabricated forms are then filled with wet cement 26 from a source such as a pump truck or from the chute 27 of a concrete truck. As the concrete fills the forms, it exerts a great deal of outward pressure on the frame members of the form, as is the case regardless of the type of form used. However, since the frame members of the form of this invention are tied together by the spot welding of the brackets 21 to the frame members and to their respective rebars, the frame of the form easily withstands the pressure of the concrete without bowing or otherwise deforming. Therefore, no ancillary reinforcing blocks or stakes, common in the prior art, are required. In addition the rigidity of the form prevents it from racking as the heavy concrete spreads throughout the form. As the concrete is poured into the form, it flows around and encases not only the rebar mat, but also the brackets at the ends of the individual rebars. This forms a solid monolithic structure as the concrete cures and the form becomes and integral part of the finished concrete wall. Once the concrete is cured, the resulting wall sections, form and all, are tilted up into place by a crane and secured to each other and to the building frame in the usual way to form concrete walls of the building.

FIG. 2 is an enlargement of a portion of the form of this invention showing details of its structure, and particularly details and interrelations of the frame, rebar, and bracket of the form. The side frame member 12 is shown attached by a weld joint 22 to an end frame member 16 forming a corner of the form. As mentioned above, the frame members are generally C-shaped or channel shaped, with the open channel of each frame member facing inwardly toward the center of the form. More specifically, the frame members, which preferably are made of roll-formed or otherwise bent sheet metal, have an outside panel portion 28 that is bent or roll formed along its edges to form inwardly extending flanges 29 and down turned lips 31. This configuration provides strength and rigidity to the frame members. However, it also forms a bit of a channel around the inside of the frame with the distance between inwardly extend flanges of opposed frame members being less than the distance between their respective outside panels.

One rebar 18 of the rebar mat 17 is visible in FIG. 2 along with the bracket 21 by which it is attached to the frame member 12. The rebar and bracket also are illustrated in phantom lines with arrows to demonstrate more clearly the positioning of the rebar mat into the form and subsequent attachment thereto by means of the bracket. As mentioned above, the individual rebars of the mat are cut short enough so that the mat can be moved into position within the form past the inwardly extending flanges 29 and down turned lips 31 of the frame members. This means that when the rebar mat is in place, there is a space between the ends of the rebars and the outside panels 28 of the frame members and thus the rebar mat cannot be attached directly to the frame. Brackets 21 were invented to address this problem and to provide additional advantages. Each bracket 21 has a base portion 32 formed by outturned welding flanges 33. A flange 34 extends from the base portion 32 and is die, or otherwise cut to form a plurality of ribs 36. Alternate ones of ribs 36 are spread apart relative to each other to form an open pocket that can be slipped over the end portion of a length of rebar as shown. When the rebar mat is installed in the form as shown in solid line FIG. 2, spot welds 37 fasten each of the brackets 21 to the outside panel of their respective frame members while spot welds 38 secure the end of the rebar to the ribs of the bracket 21, for the purposes and advantages discussed above.

The preferred installation of the rebar mat into the form is illustrated by phantom lines and arrows in FIG. 2. More specifically, prior to moving the rebar mat into the form, brackets are slipped onto the ends of the individual rebars of the mat until the end portions of the rebars protrude from the base portions of the brackets. The rebar mat may then be moved into the form as indicated by arrows 42 until it is located approximately in the mid-portion of the form. This is possible, as mentioned earlier, because the rebars are short enough to slip past the inwardly extending flanges of the frame members. With the rebar mat in position, the brackets are slid outwardly, as indicated by arrows 41, until their base portions engage the outside panel portions of the frame members, whereupon they are spot welded to the frame members and to the end portions of their respective rebars. The manufacture the form of this inventions is therefore greatly simplified as compared to the prior art but nevertheless results in a form of superior strength, light weight, portability, and rigidity.

Figure 3:
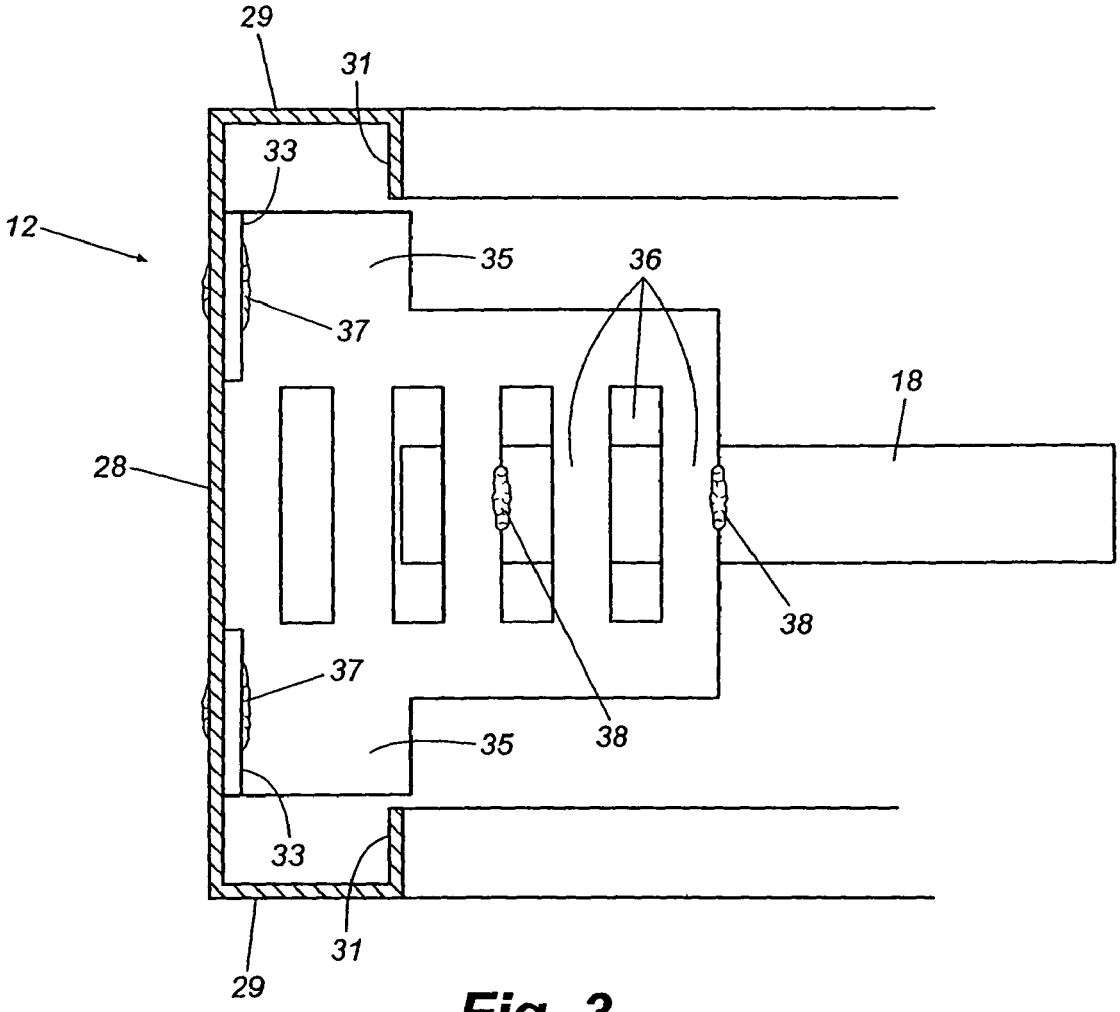
FIG. 3 is a cross-sectional view taken along A-A of FIG. 2 illustrating more clearly the relationship between the C-shaped frame members, the rebar mat, and the brackets of the invention.

FIG. 3 is a cross-sectional view taken along A-A of FIG. 2. illustrating more clearly the relationship between the rebar, bracket, and frame member. Here, the shortened length of the rebar 18 for slipping easily into the form past the inwardly extending flanges 29 is more clearly shown. The bracket 21 is shown with its base portion engaging and being spot welded at 37 to the outside panel portion 28 of the frame member and also spot welded to the end portion of the rebar at 38. Each of the brackets 21 is further formed with a pair of alignment wings that project outwardly a distance such that the alignment wings reside between the opposed inner edges of the down turned lips 31 of the frame members. In this way, the alignment wings function to align the rebar mat in the mid-portion of the form as the brackets are slid outwardly to engage the frame members and to maintain its alignment during transport and while the form is filled with wet concrete.

Figure 4:
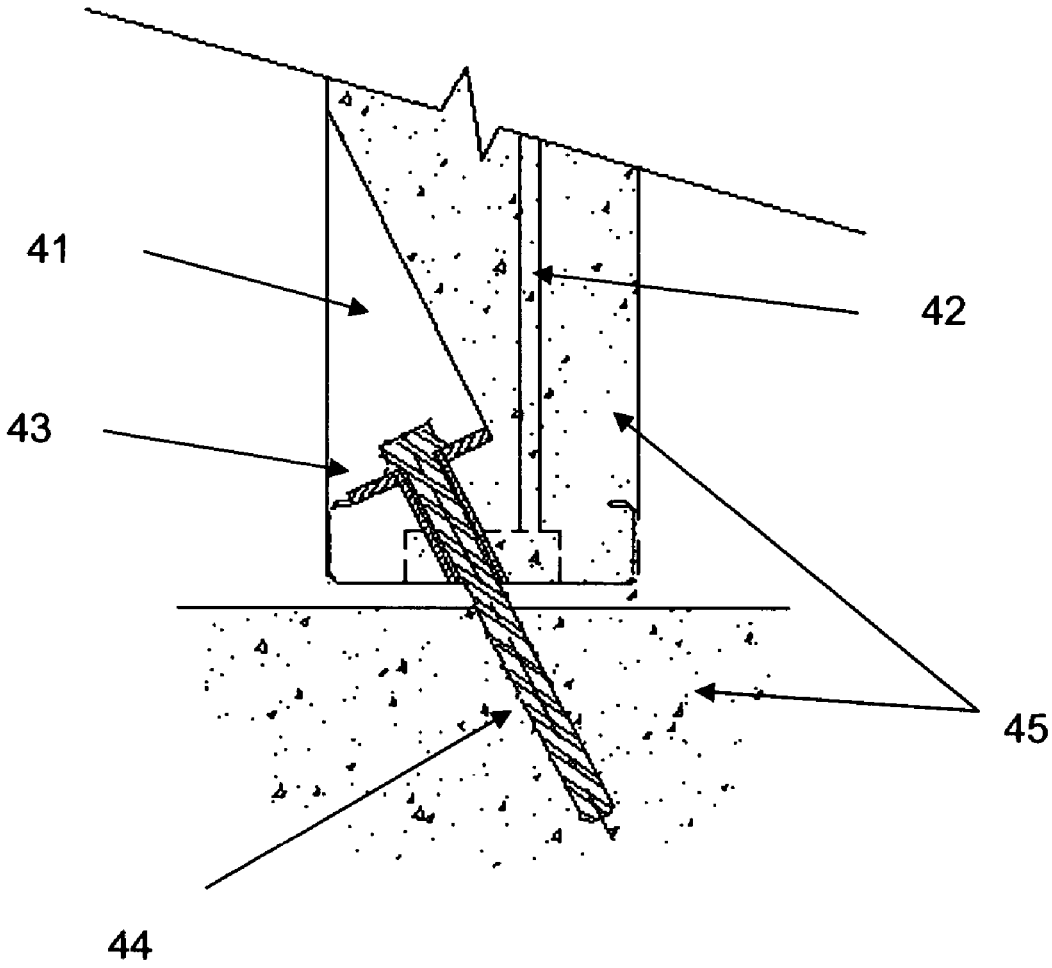
FIG. 4 is a cross-sectional view showing use of the unique anchor with the void formed by the unique pocket form including the presence of a securement device (threaded bolt) seated in the unique anchor.

A cross-sectional view of the anchor installed in the tilt-up panel is illustrated in FIG. 4, which shows a final installation of the anchor complete with an anchoring device 44, in this case a threaded bolt. The concrete wall 45 completely encases the anchor 43 and the anchor rebars 42. Access to install the anchoring device 44 is a void 41 created by the pocket form illustrated in FIG. 8. In FIG. 4 the void form has been removed for clarity.

Figure 5:
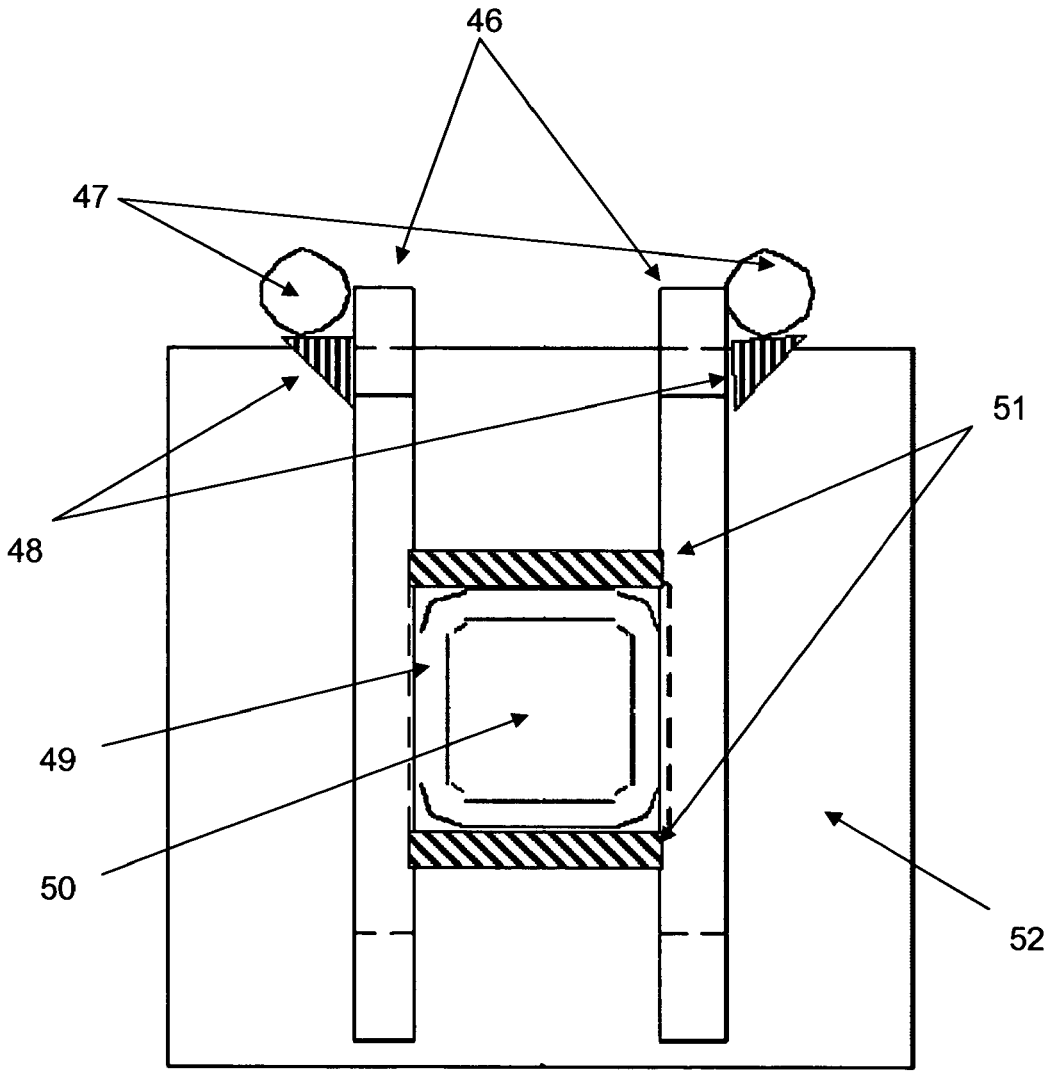
FIG. 5 is a detail showing a top view of the unique anchor pointing out the center hole, metal feet and filet weld points on the unique anchor assembly.
Figure 6:
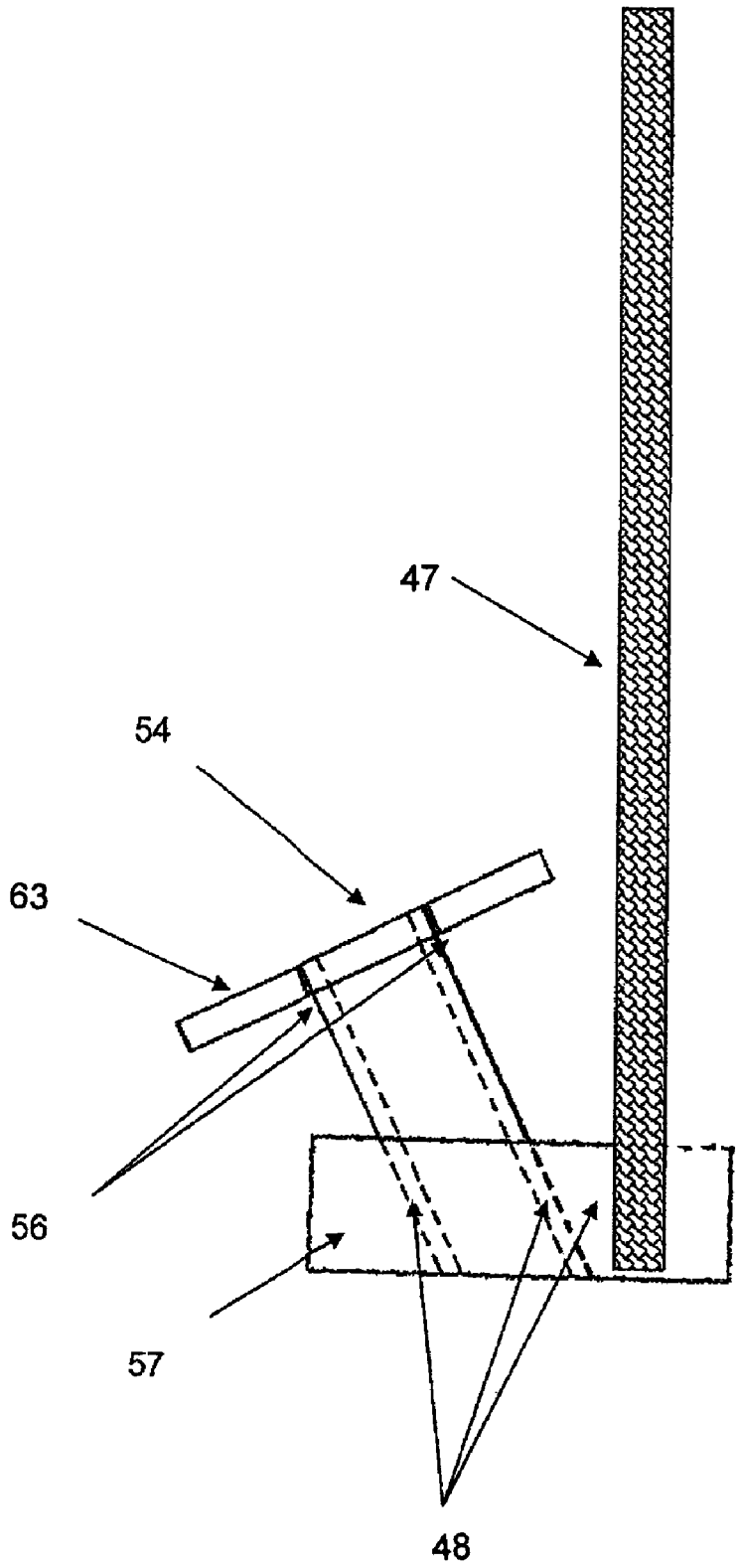
FIG. 6 is a detail showing a side view of the unique anchor with the additional structural rebar attached and filet weld points.
Figure 7:
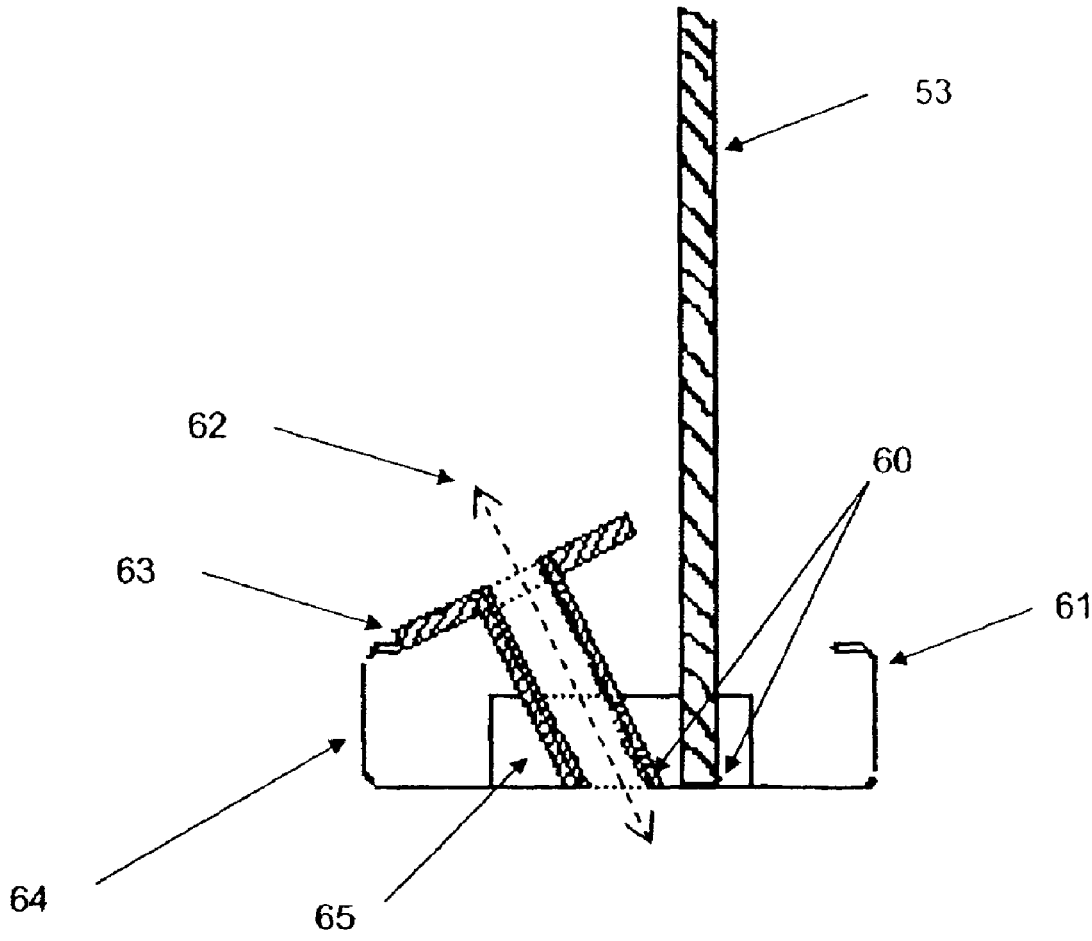
FIG. 7 is a side view of the unique anchor illustrating more clearly the relationship between the unique anchor and the form C-channel frame.

Details of a top view of the anchor is depicted in FIG. 5 showing the top metal plate 52 with the hole 50. A metal tube 49 is welded 51 to the top metal plate 52. Anchor rebar 47 is filet welded 48 to the feet 46. A side view of the anchor (FIG. 6) provides a profile view of the contour of the anchor face 55. The metal tube 54 is attached to the face plate 55 by welds at 56. The anchor feet 57 are attached to the metal tube 54 and the anchor rebar 53 at filet weld points 58. This anchor assembly is then inserted into the tilt-up panel frame as illustrated in FIG. 7. Again the positioning of the anchor face 63 into the tilt-up form frame 64 and 61 is as shown in the figures. The metal tube creates the hole 62 through the anchor and is welded to the feet as shown in FIG. 6 number 58 and is welded to the anchor rebar 53 at points 60 to make a complete unit affixed to the tilt up form.

Figure 8:
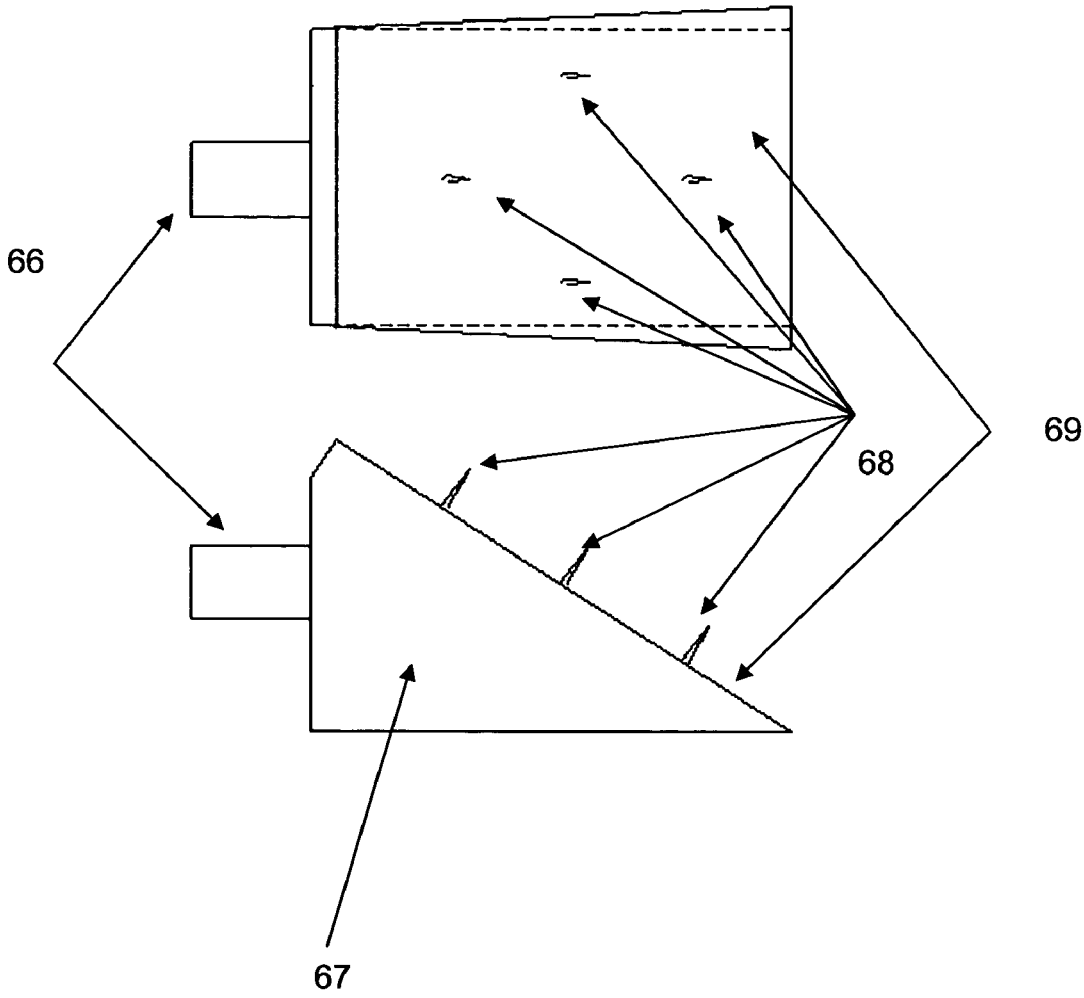
FIG. 8 is a front view over a side view of the unique pocket form depicting the location of various features including the tabs and connection to the unique anchor.

The void depicted in FIG. 4 at location number 41 is created by the anchor pocket form drawn in FIG. 8. The pocket form face 69 is cast into the concrete panel facing the outside of the panel wall with the tabs 68 sticking up above the finished concrete level to allow for easy location of the anchor at the work site. The protruding plug 66 is designed and sized to fit into the opening in the anchor and is held in place by its close fitting shape and friction. The profile of the pocket form 67 is designed to match the angle required to provide a good seal from concrete while leaving ample void room for workers to fit the head of hole making tools up to the anchor face.

The invention has been described in terms of preferred embodiments and methodologies that represent the best mode known to the inventors of carrying out the invention. It will be apparent to those of skill in the art, however, that many variations of the illustrated embodiments may be implemented, all within the scope of the invention. For example, the specific shape and construction of the brackets 21 shown in the drawings is one preferred embodiment because of its light weight and economy of fabrication. Many other bracket configurations may, however, be substituted depending upon the shape of the frame, the application, or other factors and any and all specific bracket shapes should be considered equivalent. The specific channel-shape of the frame members also may be different from that illustrated and discussed above. For instance, frame members with inwardly facing C-shaped channels are illustrated and discussed. However, the frame members can take on any of a variety of shapes and configurations depending upon structural and architectural requirements. For example, the frame members can have outwardly extending flanges rather inwardly extending flanges, obliquely projecting flanges, or may not have any flanges at all. Thus, the particular configuration of the frame members illustrated in the drawings and discussed herein is not intended to and should not be interpreted as limiting the scope of the invention. The forms themselves, although illustrated only as rectangular forms for clarity of description, may take on a wide variety of shapes depending upon the desired final shape of walls to be made with them. For instance, a wall section that will be on the end of a building may be poured in a form having a triangular upper portion to match the pitch of the building roof. These and other additions, deletions, and modifications to the particular preferred embodiment illustrated and discussed herein might well be made by those of skill in the art without departing from the spirit and scope of the invention as set forth in the claims.

What is claimed is:

1. An anchor for a form for fabricating tilt-up concrete wall sections, said anchor comprising:

a faceplate with a generally central hole attached by welding to;

a metal tube substantially aligned with the hole in the faceplate and attached by welding to;

a pair of feet plates positioned on either side of the tube and attached by welding to;

elongated structural reinforcing steel or rebar mated to;

a tilt-up concrete wall form;

the faceplate, metal tube, feet plates, and reinforcing steel all being made of metal;

a pocket form having a triangular shaped body and an end;

a protrusion from the end designed to fit into the hole of the faceplate;

a plurality of tabs on the pocket form positioned to indicate the pocket form location in a wall panel fabricated with the form.

2. A concrete wall form comprising:

a plurality of peripheral walls bounding an interior of the form into which concrete is to be poured;

a base member sized and configured to be secured to one of the peripheral walls on the interior of the form;

at least one reinforcing bar affixed to the base member and extending inwardly into the interior of the form;

a tube having a central opening and being affixed to the base member extending therefrom at an angle relative to the peripheral wall to a distal end; and a removable pocket form having a protrusion extending away from a base of said removable pocket form, said protrusion adapted to fit into the tube and a configuration that creates a pocket within concrete poured into the form, the pocket permitting access to the tube for installing an anchor through the tube when the pocket form is removed wherein the tube has a central opening and further comprising a faceplate having a hole and being affixed to the distal end of the tube with its hole substantially aligned with the central opening of the tube.

3. A concrete wall form as claimed in claim 2 and wherein the pocket form is generally triangular in shape.

4. A concrete wall form as claimed in claim 2 and further comprising at least one indicator on the pocket form, the indicator configured to protrude from concrete poured into the form to indicate the position of the pocket form.

5. A concrete wall form as claimed in claim 4 and wherein the at least one indicator comprises a plurality of tabs projecting from the pocket form.

6. A concrete wall form as claimed in claim 2 and wherein the walls, base member, reinforcing bar, and tube are fabricated of metal.

7. A concrete wall form as claimed in claim 2 and wherein the base member comprises a pair of feet plates on either side of the tube, the reinforcing bar being affixed to the feet plates.

* * * * *